US005726407A

United States Patent [19]

Okutomi et al.

[11] Patent Number: 5,726,407

[45] Date of Patent: Mar. 10, 1998

[54] CONTACT ELECTRODE FOR VACUUM INTERRUPTER

[75] Inventors: Tsutomu Okutomi, Kanagawa-ken; Tsuneyo Seki; Atsushi Yamamoto, both of Tokyo, all of Japan

[73] Assignee: Kabushiki Kaisha Toshiba, Kawasaki, Japan

[21] Appl. No.: 611,000

[22] Filed: Mar. 7, 1996

[30] Foreign Application Priority Data

Mar. 10, 1995 [JP] Japan ..... 7-051102

[51] Int. Cl.[6] ..... H01H 33/66; H01H 1/02

[52] U.S. Cl. ..... 218/130; 218/132

[58] Field of Search ..... 218/118–136; 200/262–270

[56] References Cited

U.S. PATENT DOCUMENTS

| | | | |
|---|---|---|---|
| 3,551,622 | 12/1970 | Takeuchi et al. | 218/132 |
| 3,634,736 | 1/1972 | Boos et al. | 361/502 |
| 3,770,497 | 11/1973 | Hassler et al. | 218/130 |
| 4,088,803 | 5/1978 | Kubo et al. | 200/268 X |
| 4,546,222 | 10/1985 | Watanabe et al. | 218/130 X |
| 4,777,335 | 10/1988 | Okutomi et al. | 218/130 X |
| 4,830,821 | 5/1989 | Okutomi et al. | 419/25 |
| 5,045,281 | 9/1991 | Okutomi et al. | 200/262 |
| 5,149,362 | 9/1992 | Okutomi et al. | 200/265 X |
| 5,420,384 | 5/1995 | Okutomi et al. | 218/68 |

FOREIGN PATENT DOCUMENTS

| | | |
|---|---|---|
| 63-266720 | 11/1988 | Japan . |
| 4-242029 | 8/1992 | Japan . |

*Primary Examiner*—J. R. Scott

*Attorney, Agent, or Firm*—Oblon, Spivak, McClelland, Maier & Neustadt, P.C.

[57] ABSTRACT

A contact electrode for a vacuum interrupter including a conductive component having at least one selected from the group consisting of copper and silver, and an arc-proof component with a melting temperature of more than 1500° C. In the contact electrode, a gradient A/X of a quantity of a composition component of the contact electrode on a surface or the contact electrode is 0.2–12 volume %/mm. Where, X1 is one point on the line of any radius R1 on the surface of the contact electrode, X2 is another point on the line of the radius R1 on the surface of the contact electrode, and X is a gap between the one point X1 and the another point X2 measured by mm, where X=X2–X1, and X2>X1 ≧0. A1 is a quantity of the composition component measured by volume % in the contact electrode at the one point X1, A2 is a quantity of the composition component measured by volume % in the contact electrode at the another point X2 and A is a difference between the quantities A1 and A2 of the composition component measured by volume %, where A=A2–A1.

12 Claims, 2 Drawing Sheets

CONTACT ELECTRODE FOR VACUUM INTERRUPTER

BACKGROUND OF THE INVENTION

1. Field of the Invention

This invention relates to a contact electrode for a vacuum interrupter used in a vacuum circuit breaker, and more particularly to a contact electrode for a vacuum interrupter used in a vacuum circuit breaker with both excellent large current interrupting characteristics and withstanding voltage characteristics.

2. Description of the Related Art

As shown in FIG. 1, a vacuum interrupter is generally composed as follows. A vacuum vessel 4 is constructed by hermetically sealing end plates 2 and 3 to the openings at both ends of an insulating cylinder 1. A pair of contact electrodes 5 and 6, which are free to make contact and separate, are provided inside vacuum vessel 4. A fixed stem 7 for contact electrode 5 is hermetically mounted on end plate 2, while a movable conducting stem 8 for contact electrode 6 is hermetically mounted on end plate 3 via bellows 9 so that it is free to move. Also, contact electrodes 5 and 6 are enveloped by an arc shield 10. Furthermore, a bellows cover 11 for bellows 9 is mounted on mobile conducting stem 8.

In this type of vacuum interrupter, when movable conducting stem 8 is operated in the disengagement direction by an operating mechanism (not illustrated), contact electrodes 5 and 6 are separated. The arcs generated between contact electrodes 5 and 6 at this time are diffused in the vacuum inside the vacuum interrupter when the current reaches the zero point, thus breaking the circuit current.

Contact electrodes 5 and 6 for this type of vacuum interrupter are composed of various materials in order to maintain and improve their anti-welding characteristics, withstanding voltage characteristics, interrupting characteristics, current chopping characteristics, anti-wear characteristics, contact resistance characteristics, temperature rise characteristics, etc.

However, the above required characteristics require material properties which are mutually conflicting. Thus, it is impossible fully to satisfy them using a single element. Therefore, attempts have been made fully to satisfy the above fundamental characteristics by combining materials.

In case that a vacuum interrupter is composed of contact electrodes using such materials, when a large current is to be interrupted, there are sometimes retention of the arcs generated by interrupting the large current in the parts of contact electrodes where arc voltages are low. Thus, it is not possible to cause uniform ignition of the arcs on the entire surfaces of the contact electrodes.

As a means of reducing arc retention, a technique of providing coil electrodes to apply a magnetic field in the axial direction parallel to the axis of the arcs generated between the electrodes at interrupting, is disclosed in Japanese Patent Registration No. 1140613, as a technique for devising, not only contact materials, but also electrode structures, for large current interrupting.

As another means of reducing arc retention, although it is mainly focused on interrupting small currents because its aim is improvement of the current interrupting characteristics, contact electrodes which assist arc travel by providing multiple contact domains having different boiling temperatures on the contact electrodes is proposed in Japanese Laid-Open Patent No. Showa 62-64012.

As a further means of reducing arc retention, contact electrodes which assist arc travel by providing multiple contact domains having different boiling temperatures on the contact electrodes is proposed in Japanese Laid-Open Patent No. Showa 63-266720, with the same aim of improving the current chopping characteristics as in the above described Showa 62-64012.

Furthermore, with the same aim, concrete proposals for basic materials used in multiple contact domains are made, as shown by the combination of AgWC and CuCr in Japanese Laid-Open Patent No. Heisei 04-20978, the combination of AgWC and CuTi in Japanese Laid-Open patent No. Heisei 04-242029 and the combination of $AgMo_2C$ and CuCr in Japanese Laid-Open Patent No. Heisei 05-47275.

However, in such contact electrodes in which two or more contact electrodes having different arc voltages are arranged on the same surface, the arcs concentrate at the parts where the arc voltages are low, even with the above axial direction magnetic field electrodes. Thus, they do not become contact electrodes which completely assist arc travel. Therefore, they do not achieve the exhibition of the characteristics of the technique of an axial direction magnetic field effective in large current interruption.

Also, there are contact electrodes which are the combinations of AgWC and CuCr, the combinations of AgWC and CuTi and combinations of $AgMo_2C$ and CuCr as described above. With these contact electrodes, the arcs at the time of large current interruption polarise in the parts where the arc voltages are low, the same as described above. Thus, although improvement of the low current chopping characteristics are obtained in these contact electrodes, they are not satisfactory from the viewpoint of improvement of the large current interrupting characteristics.

SUMMARY OF THE INVENTION

Accordingly, one object of this invention is to provide a contact electrode for a vacuum interrupter used in a vacuum circuit breaker which can improve the large current interrupting characteristics of the vacuum circuit breaker.

Another object of this invention is to provide a contact electrode for a vacuum interrupter used in a vacuum circuit breaker which can maintain an excellent withstanding voltage characteristics of the vacuum circuit breaker.

These and other objects of this invention can be achieved by providing a contact electrode for a vacuum interrupter including a conductive component having at least one selected from the group consisting of copper and silver, and an arc-proof component with a melting temperature of more than 1500° C. In the contact electrode, a gradient A/X of a quantity of a composition component of the contact electrode on a surface of the contact electrode is 0.2–12 volume %/mm. Where, X1 is one point on the line of any radius R1 on the surface of the contact electrode, X2 is another point on the line of the radius R1 on the surface of the contact electrode, and X is a gap between the one point X1 and the another point X2 measured by mm, where $X=X2-X1$, and $X2>X1\geqq 0$. A1 is a quantity of the composition component measured by volume % in the contact electrode at the one point X1, A2 is a quantity of the composition component measured by volume % in the contact electrode at the another point X2, and A is a difference between the quantities A1 and A2 of the composition component measured by volume %, where $A=A2-A1$.

In order to achieve the above objects, a contact electrode for a vacuum interrupter is provided according to this invention in which the gradient of the composition component quantity of the contact electrode is restricted to the desired values for improving the large current interrupting characteristics.

Therefore, in the case of a large current interruption, the retention of the arcs generated by interrupting the large current in the parts of contact electrode where the arc voltages are low is reduced, and thereby the arcs ignite evenly on the whole of the surfaces of the contact electrodes. That is to say, the arcs travel readily on contact electrodes which have the gradient of composition component of specified values. Therefore, diffusion of the arcs is accelerated, with the result that the contact electrode surface areas which substantially handle to interrupt current, are increased, thereby to contribute to the improvement of the interrupting current characteristics.

Furthermore, as a result of the reduction of retention of the arcs, the advantages of the prevention of the phenomenon of local abnormal evaporation of the contact electrodes and the reduction of surface roughening are also obtained.

Generally, contact electrodes are made with an entirely uniform composition. Even in the contact electrodes with this type of normal composition distribution, when an external magnetic field (for instance a longitudinal magnetic field) is applied to contact electrodes, the arcs generated by interrupting the current spread evenly on the contact electrodes and travel and diffuse. Thus, the current interrupting characteristics is, to some extent, improved.

By observation, when a current of more than a fixed value is interrupted, arcs are retained at an unpredictable point or multiple points to cause abnormal melting of the contact electrodes where the arcs are retained. Also, the metallic vapor generated by the momentary explosive vaporization of the contact electrode material in the abnormal melting significantly retards the insulation recovery of the vacuum circuit breaker in the process of contact opening. These lead to the deterioration of the interrupting characteristics of the contact electrode. Furthermore, abnormal melting produces giant molten drops of the contact electrode material, leading to the roughness of the surfaces of the contact electrodes, and also leading to the reduction of the withstanding voltage characteristics, the increase of the re-ignition occurrence factor, and the abnormal consumption of material.

The position of retention on the contact electrodes of the arcs, which are the cause of these phenomena, is completely unpredictable, as mentioned above. Therefore, it is desirable to give surface conditions to the contact electrodes so that the generated arcs can travel and diffuse without causing retention. In this invention, these desirable conditions are readily achieved by the giving of a specified composition component gradient in the radial direction of the contact electrode surfaces, thereby the marginal value of the interrupting current and also current interrupting characteristics can be improved.

By experiment, the giving of this specified composition component gradient in the radial direction may be through the whole thickness of the contact electrodes in the case of contact electrodes which take the anti-wear property into consideration. However, in the vacuum circuit breakers designed for fewer interruptions or in the contact electrodes which take account of contact resistivity, there is not always a requirement for a specified composition component quantity gradient throughout their entire thickness. The function will be exhibited even if there is a specific depth domain of, for example 0.01 mm, in the thickness direction (the inward direction) from the uppermost layer of the contact electrodes in which the specified composition component gradient is arranged. In this case, a material (for instance, pure copper) having a larger electrical conductivity than this composition is arranged under the layer of this composition, in deeper position from the surface by more than 0.01 mm, so as to improve the electrical conductivity of the entire contact electrodes, leading to the further improvement of the current interrupting characteristics.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
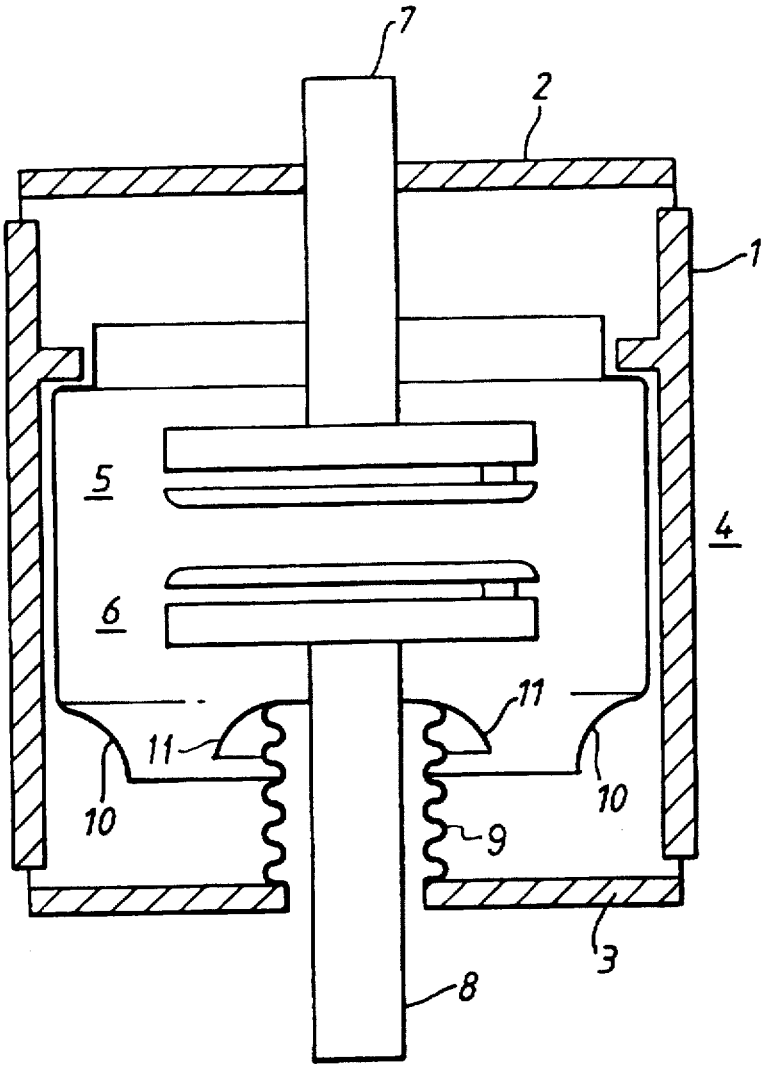
FIG 1 is a cross-section showing an example of a vacuum interrupter to which this invention is applied.

Referring now to the drawing, the embodiments of this invention will be described below.

First, the methods of manufacturing contact electrode test samples will be described.

The contact electrode test samples (contact electrode materials) are produced by, for instance, suitably selecting one of the following First to Third Methods.

The First Method is a method of producing a test sample by mixing specified proportions of conductive component powder, are-proof component powder and, it required, auxiliary component powder, and then heating and sintering the mixed powder at less than their melting points.

The Second Method is a method of producing a test sample as follows. First, by heating and sintering arc-proof component powder and, if required, auxiliary component powder at less than their melting points, an arc-proof component skeleton having a specified porosity is obtained. Then, the remaining component is heated and infiltrated at more than its melting temperature into the pores of the heated skeleton to obtain a test sample.

The Third Method is a method of producing a test sample by spray-depositing or melt-spray-depositing the mixed powder of specified proportions of conductive component powder, arc-proof powder and, if required, auxiliary component powder, in a specified location on a substrate, such as a copper plate or a contact electrode sample. Heat treatment is then applied to this to obtain a test sample.

For the technique of giving a specified composition component quantity gradient A/X on the contact electrode surface, test pieces having the specified component composition quantity gradients are produced by such methods as follows. First, mixed powder green compacts composed of different components are produced, respectively. For instance, in the case of two types, one is made ring-shaped and the other is made disc-shaped. These two mixed powder green compacts are combined and arranged so as to give a specified composition component quantity A/X. Then, these two mixed powder green compacts are heated and sintered in an incorporated state at below their melting points.

Second, there is a method of first producing mixed powder green compacts which have different components. For instance, in the case of two types, one is made ring-shaped and the other is made disc-shaped. These are then sintered to obtain two sintered bodies. These two sintered bodies are combined so that gradient A/X is given to obtain a test sample.

In these cases, in order to cause gradient A/X to vary significantly, it is advantageous to make adjustments by the mixing ratio of the conductive component powder and the arc-proof component powder.

Also, in order to cause gradient A/X to vary within a narrow range, it is advantageous to make fine adjustments by appropriately performing variation of the particle size of the arc-proof component powder, variation of the molding pressure of the arc-proof component powder, and variation of the sintering temperature and time.

In practice, these are carried out by appropriate combination. That is, test-pieces with specified composition component quantity gradients A/X are produced by the following methods. Arc-proof component powders having multiple components are sintered beforehand below their melting points, for instance, in the case of two types, one is ring-shaped while the other is disc-shaped, when there are three types, there are two ring-shaped pieces and one disc-shaped piece.

Thus, arc-proof component skeletons having specified porosities are obtained. These two or three skeletons are arranged so as to give gradient A/X and the remaining powder is heated at more than its melting temperature and infiltrated into the pores of the skeletons to obtain a test sample.

In the above-described test samples, the contact electrodes are given gradient A/X throughout their entire thickness. However, other test samples composed of multiple layers can be provided, in which contact electrode materials with specified composition component quantity gradient are arranged on a Cu plate or a CuAg Plate of thickness 1–5 mm.

Next, the evaluation methods of test samples manufactured as described above will be described below. First, as that samples, disc-shaped contact electrode pieces of contact diameter 45 mm, contact thickness 5 mm, having specified composition component gradients A/X on the contact electrode surfaces were fitted in a demountable-type vacuum circuit breaker. Then, the baking of the contact electrode surfaces, their current and voltage agings were made for test samples under the same and constant conditions. Then the following three evaluations were made for each of test samples.

(1) Arc Spread

Opening speed conditions for contact electrodes were made constant and identical. The areas of the arcing portions after the current 12 kA was interrupted 4 times at 7.2 kV, 50 Hz were measured with a planimeter. Taking the measured areas for arc spread for respective contact electrode materials, these were judged by their values relative to the arc spread value of the reference contact electrode. Hereinafter, Example 1 is taken as the reference contact electrode.

(2) Interrupting Characteristics

Opening speed condition for contact electrodes were made constant and identical. The interrupting current value were gradually increased from 5 kA at 7.2 kV, 50 Hz. The marginal interruption current values of respective contact electrode materials were obtained. These were judged by their values relative to the marginal interruption current value of the reference contact electrode.

(3) Static withstanding Voltage Characteristics

The contact electrodes which had been evaluated for arc spread as above were returned to the demountable vacuum circuit breaker. The baking of the contact electrode surfaces, their current and voltage ageing were made for test samples under the constant and identical conditions. After the inter-electrode distance had been adjusted to a specified value, the voltages were increased by 1 kV at a time, and the voltages when sparks occurred were obtained as respective static withstanding-voltage values. These were judged by their values relative to the static withstanding voltage of the reference contact electrode.

Figure 2:
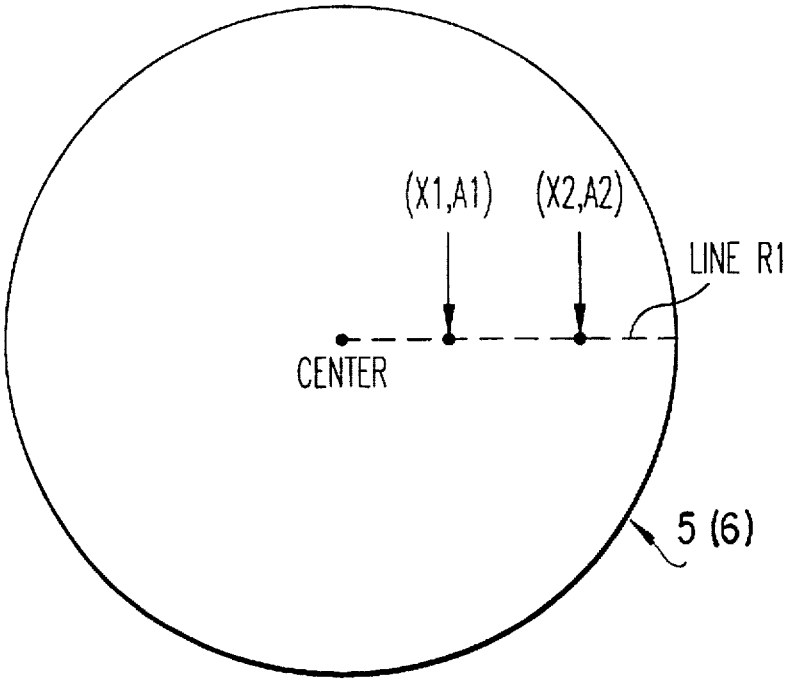
FIG. 2 shows a top view of an example of a contact electrode for the vacuum interrupter of FIG. 1.
Figure 3A:
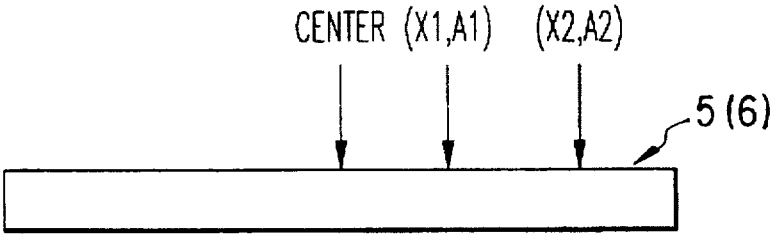
FIG. 3(A) shows a section of a first embodiment of the contact electrode of FIG. 2.
Figure 3B:
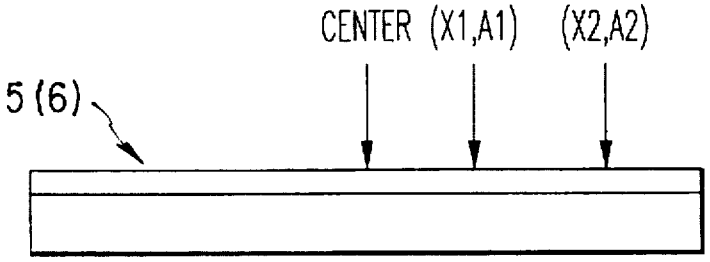
FIG. 3(B) shows a section of a second embodiment of the contact electrode of FIG. 2.

The following is a description of the effects of contact electrodes according to this invention with reference to Table 1 to Table 3 which show the arc spreads, the interrupting multiplying factors and the static withstanding voltage characteristics for respective contact electrodes. Here, a gradient wherein composition component quantity gradient A/X given on the contact electrode surface which is less than 0.2 (volume %/mm) is taken as Domain I, a gradient of 0.2–12 (volume %/mm) is taken as Domain II; and a gradient of more than 12 (volume %/mm) is taken as Domain III. Here, A is the difference between a composition component quantity A1 at any point X1 and a composition component quantity A2 at any other point X2 on a radial line R1 of the contact electrode sample illustrated in FIGS. 2 and 3(A) wherein X is the distance between points X1 and X2. A/X is a gradient of the composition component quantities A1 and A2 between points X1 and X2 as mentioned above relative to the third method of providing a test sample, and as illustrated in FIG. 3(B), the contact electrode can be a thin layer (12) provided on a suitable substrate (13).

EXAMPLES 1–3

Comparative Examples 1–3

In Example 1, powder consisting of a mixture of Cr powder of mean grain size 100 μm and Cu powder of mean grain size 44 μm mixed at a ratio so as to form 30 volume % Cr—Cu was molded at a molding pressure of 7 Ton/cm$^2$. It was then sintered under conditions of 1060° C.×1 Hr. in a hydrogen atmosphere to obtain a 30Cr—Cu material. It was then mechanically processed to form a disc shaped body of a diameter of 25 mm. Powder consisting of a mixture of the above-described powders mixed at a Patio so as to form 33 volume % Cr—Cu was molded at a molding pressure of 7 Ton/cm$^2$. It was then sintered under the above-described conditions to obtain a 33Cr—Cu material. It was then mechanically processed to form a ring shaped body of an inside diameter of 25 mm and an outside diameter of 45 mm. A contact electrode material was then obtained by combining these two bodies in which an inner portion is composed of the 30Cr—Cu material and an outer portion is composed of the 33Cr—Cu material. In this contact electrode material, a mean gradient A/X of Cr component between any point X1 and a point X2 15 mm distant from it across the boundary of these two bodies on any radial line R1 became A/X=0.2 (volume %/mm). The evaluation data for this test piece (Example 1) were taken as the reference value.

In Example 2, a disc shaped body of a diameter of 25 mm composed of a 30Cr—Cu material was obtained in the same manner as in Example 1. Similarly, a ring shaped body of an inside diameter of 25 mm and an outside diameter of 45 mm composed of a 42.5Cr—Cu material was obtained in the same manner as in Example 1. A contact electrode material was then obtained by combining these two bodies in which an inner portion is composed of the 30Cr—Cu material and an outer portion is composed of the 42.5Cr—Cu material. In this contact electrode material, a mean gradient A/X between any point X1 and a point X2 5 mm distant from it across the boundary of these two bodies on any radial line R1 became A/X=2.5 (volume %/mm).

In Example 3, a disc shaped body of a diameter of 25 mm composed of a 5Cr—Cu material was obtained in the same manner as in Example 1. Similarly, a ring shaped body of an inside diameter of 25 mm and an outside diameter of 45 mm composed of a 65Cr—Cu material was obtained in the same manner as in Example 1. A contact electrode material was then obtained by combining these two bodies in which an inner portion is composed of the 5Cr—Cu material and an outer portion is composed of the 65Cr—Cu material. In this contact electrode material, a mean gradient A/X of Cr component between any point X1 and a point X2 5 mm distant from it across the boundary of these two bodies on any radial line R1 became A/X=12 (volume %/mm).

In Comparative Example 1, a disc shaped body of a diameter of 45 mm composed of a 30Cr—Cu material was obtained in the same manner as in Example 1, which was used a contact electrode material for Comparative Example 1. In this contact electrode material, a mean gradient A/X of Cr component became apparently A/X=0 (volume %/mm).

In Comparative Example 2, a disc shaped body of a diameter of 25 mm composed of a 30Cr—Cu material was obtained in the same manner as in Example 1. Similarly, a ring shaped body of an inside diameter of 25 mm and an outside diameter of 45 mm composed of a 32.4Cr—Cu material was obtained in the same manner as in Example 1. A contact electrode material was then obtained by combining these two bodies in which an inner portion is composed of the 30Cr—Cu material and an outer portion is composed of the 32.4Cr—Cu material. In this contact electrode material, a mean gradient A/X of Cr component between any point X1 and a point X2 15 mm distant from it across the boundary of these two bodies on any radial line R1 became A/X=0.16 (volume %/mm).

In Comparative Example 3, a disc shaped body of a diameter of 25 mm composed of a 0Cr—Cu material (100% Cu) was obtained in the same manner as in Example 1. Similarly, a ring shaped body of an inside diameter of 25 mm and an outside diameter of 45 mm composed of a 100Cr—Cu material (100% Cr) was obtained in the same manner as in Example 1. A contact electrode material was then obtained by combining these two bodies in which an inner portion is composed of the 0Cr—Cu material and an outer portion is composed of the 100Cr—Cu material. In this contact electrode material, a mean gradient A/X of Cr component between any point X1 and a point X2 5 mm distant from it across the boundary of these two bodies on any radial line R1 became A/X=20 (volume %/mm).

The results were obtained that when the values of gradients A/X were 0.2–12 (Examples 2, 3) as shown in Table 1, significant improvement was observed in both the arc spread properties and the interrupting performances of respective Examples 2, 3 over the values of Example 1 which were taken as the reference data. On the other hand, when the value of gradient A/X was 0 (comparative Example 1), as shown in Table 1 the arc spread was small compared with Example 1, that is arc retention was observed at a specific location on the contact electrode surface which was considered to be close to the arc emission point, as in clear from Table 1.

Retention of the arc, with no great difference from Comparative Example 1, was observed even when the value of gradient A/X was 0.16 (comparative Example 2).

Both the arc spread and the interrupting performance were greatly reduced in respective Comparative Examples 1, 2 when compared with the value of A/X being 0.2 (Example 1).

It was difficult to produce contact electrodes with very large diameters. Therefore, a sample piece in which the value of A/X was 20 was made as Comparative Example 3. Although there was a tendency to reduction of the arc retention phenomenon in Comparative Example 3 than when the value of A/X was 0 (Comparative Example 1), this reduction was judged to be insufficient.

The static withstanding voltages in Examples 1–3 and Comparative Examples 1–2 were judged to be desirable because there were no significant differences, as shown in Table 1. However, in Comparative Example 3, the occurrence of reduction and randomness in the static withstanding voltages was observed. Therefore, in this invention, the range of 0.2–12 (Examples 1–3) including Example 1 was taken as the desirable range for the value of gradient A/X.

EXAMPLES 5–8

In the above Examples 1–3 and Comparative Examples 1–3, examples were given in each of which the entire contact electrode surface was provided with the uniform composition component gradient. However, this invention is not limited to these examples. The same effects can be obtained even if the contact electrode surface is provided with multiple domains having different gradients, respectively, instead of one.

In Example 5, a disc shaped body of a diameter of 15 mm composed of a 30Cr—Cu material was obtained in the same manner as in Example 1. Similarly, a first ring shaped body of an inside diameter of 15 mm and an outside diameter of 35 mm composed of a 32.4Cr—Cu material and a second ring shaped body of an inside diameter of 35 mm and an outside diameter of 45 mm composed of a 45Cr—Cu material were obtained in the same manner as in Example 1. A contact electrode material was then obtained by combining these three bodies in which an inner portion is composed of the 30Cr—Cu material, an intermediate portion is composed of the 32.4Cr—Cu material, and an outer portion is composed of the 45Cr—Cu material. In this contact electrode material, a mean gradient A/X of Cr component between any point X1 and a point X2 15 mm distant from it across the boundary of the disc shaped body and the first ring shaped body on any radial line R1 became A/X=0.16 (volume %/mm), and a mean gradient A/X of Cr component between any point X1 and a point X2 5 mm distant from it across the boundary of the first and second ring shaped bodies on any radial line R1 became A/X=2.5 (volume %/mm).

In Example 6, a disc shaped body of a diameter of 15 mm composed of a 25Cr—Cu material was obtained in the same manner as in Example 1. Similarly, a first ring shaped body of an inside diameter of 15 mm and an outside diameter of 35 mm composed of a 37.5Cr—Cu material and a second ring shaped body of an inside diameter of 35 mm and an outside diameter of 45 mm composed of a 60Cr—Cu material were obtained in the same manner as in Example 1. A contact electrode material was then obtained by combining these three bodies in which an inner portion is composed of the 25Cr—Cu material, an intermediate portion is composed of the 37.5Cr—Cu material, and an outer portion is composed of the 60Cr—Cu material. In this contact electrode material, a mean gradient A/X of Cr component between any point X1 and a point X2 5 mm distant from it across the boundary of the disc shaped body and the first ring shaped body on any radial line R1 became A/X=2.5 (volume %/mm), and a mean gradient A/X of Cr component between any point X1 and a point X2 5 mm distant from it across the boundary of the first and second ring shaped bodies on any radial line R1 became A/X=4.5 (volume %/mm).

In Example 7, a disc shaped body of a diameter of 15 mm composed of a 5Cr—Cu material was obtained in the same manner as in Example 1. Similarly, a first ring shaped body of an inside diameter of 15 mm and an outside diameter of 35 mm composed of a 17.5Cr—Cu material and a second ring shaped body of an inside diameter of 35 mm and an outside diameter of 45 mm composed of a 87.5Cr—Cu material were obtained in the same manner as in Example 1. A contact electrode material was then obtained by combining these three bodies in which an inner portion is composed of the 5Cr—Cu material, an intermediate portion is composed of the 17.5Cr—Cu material, and an outer portion is composed of the 87.5Cr—Cu material. In this contact electrode material, a mean gradient A/X of Cr component between any point X1 and a point X2 5 mm distant from it across the boundary of the disc shaped body and the first ring shaped body on any radial line R1 became A/X=2.5 (volume %/mm), and a mean gradient A/X of Cr component between any point X1 and a point X2 5 mm distant from it across the boundary of the first and second ring shaped bodies on any radial line R1 became A/X=14 (volume %/mm).

In Example 8, a disc shaped body of a diameter of 10 mm composed of a 0Cr—Cu material was obtained in the same manner as in Example 1. Similarly, a first ring shaped body of an inside diameter of 10 mm and an outside diameter of 20 mm composed of a 2.4Cr—Cu material, a second ring shaped body of an inside diameter of 20 mm and an outside diameter of 30 mm composed of a 15Cr—Cu material and a third ring shaped body of an inside diameter of 30 mm and an outside diameter of 45 mm composed of a 85Cr—Cu material were obtained in the same manner as in Example 1. A contact electrode material was then obtained by combining these four bodies in which an inner portion is composed of the 0Cr—Cu material, a next inner portion is composed of the 2.4Cr—Cu material, a next inner portion is composed of the 15Cr—Cu material and an outer portion is composed of the 85Cr—Cu material. In this contact electrode material, a mean gradient A/X of Cr component between any point X1 and a point X2 15 mm distant from it across the boundary of the disc shaped body and the first ring shaped body on any radial line R1 became A/X=0.16 (volume %/mm), a mean gradient A/X of Cr component between any point X1 and a point X2 5 mm distant from it across the boundary of the first and second ring shaped bodies on any radial line R1 became A/X=2.5 (volume %/mm) and a mean gradient A/X of Cr component between any point X1 and a point X2 5 mm distant from it across the boundary of the second and third ring shaped bodies on any radial line R1 became A/X=14 (volume %/mm)

In Examples 5–8, Cu was used for the conductive component and Cr was used for the arc-proof component in the test samples. Moreover, gradients A/X of arc-proof component Cr were given in the test samples, as shown in Table 1. Here, Example 4 was deleted.

The evaluation results, of Examples 5–8 are shown in Table 1. As is clear from Table 1, it is observed that, if any domain having gradient value A/X of 0.2–12 exists, even in a part of the contact electrode surface, both the arc spread property and the interrupting performance are significantly improved when compared with Example 1 having gradient value A/X of 0.2.

Also, the static withstanding voltage values were judged as in the desirable ranges because there were no significant differences. Therefore, there is not a requirement for a domain in which the value of gradient A/X is 0.2–12 to exist on the entire contact electrode surface as in Examples 1–3. It was proved that, if any domain having gradient value A/X of 0.2–12 exists on a part of the contact electrode surface, satisfactory functions are exhibited.

EXAMPLES 9–15

In the above Examples 1–8 and Comparative Examples 1 3, examples were given in which CuCr was taken as the contact electrode material, as shown in Table 1. However, this invention is not limited to these examples. The contact electrode material can be selected as in the following Examples 9–15.

In Example 9, powder consisting of a mixture of Ti powder of mean grain size 100 μm and Cu powder of mean grain size 44 μm mixed at a ratio so as to form 25 volume % Ti—Cu was molded, sintered and mechanically processed in the same manner as in Example 1 to obtain a disc shaped body of a diameter of 25 mm composed of a 25Ti—Cu material. Similarly, a ring shaped body of an inside diameter of 25 mm and an outside diameter of 45 mm composed of a 37.5Ti—Cu material was obtained in the same manner as in Example 1. A contact electrode material was then obtained by combining these two bodies in which an inner portion is composed of the 25Ti—Cu material and an outer portion is composed of the 37.5Ti—Cu material. In this contact electrode material, a mean gradient A/X of Ti component between any point X1 and a point X2 5 mm distant from it across the boundary of these two bodies on any radial line R1 became A/X=2.5 (volume %/mm).

In Example 10, by using powder consisting of a mixture of Zr powder of mean grain size 100 μm and Cu powder of mean grain size 44 μm, a disc shaped body of a diameter of 25 mm composed of a 32Zr—Cu material was obtained in the same manner as in Example 1. Similarly, a ring shaped body of an inside diameter of 25 mm and an outside diameter of 45 mm composed of a 44.5Zr—Cu material was obtained in the same manner as in Example 1. A contact electrode material was then obtained by combining these two bodies, in which a mean gradient A/X of Zr component between any point X1 and a point X2 5 mm distant from it across the boundary of these two bodies on any radial line R1 became A/X=2.5 (volume %/mm).

In Example 11, by using powder consisting of a mixture of V powder of mean grain size 100 μm and Cu powder of mean grain size 44 μm, a disc shaped body of a diameter of 25 mm composed of a 30V—Cu material was obtained in the same manner as in Example 1. Similarly, a ring shaped body of an inside diameter of 25 mm and an outside diameter of 45 mm composed of a 42.5V—Cu material was obtained in the same manner as in Example 1. A contact electrode material was then obtained by combining these two bodies, in which a mean gradient A/X of V component between any point X1 and a point X2 5 mm distant from it across the boundary of these two bodies on any radial line R1 became A/X=2.5 (volume %/mm).

In Example 12, by using powder consisting of a mixture of Nb powder of mean grain size 80 μm and Cu powder of mean grain size 44 μm, a disc shaped body of a diameter of 25 mm composed of a 42Nb—Cu material was obtained in the same manner as in Example 1. Similarly, a ring shaped body of an inside diameter of 25 mm and an outside diameter of 45 mm composed of a 54.5Nb—Cu material was obtained in the same manner as in Example 1. A contact electrode material was then obtained by combining these two bodies, in which a mean gradient A/X of Nb component between any point X1 and a point X2 5 mm distant from it across the boundary of these two bodies on any radial line R1 became A/X=2.5 (volume %/mm).

In Example 13, by using powder consisting of a mixture of Ta powder of mean grain size 80 μm and Cu powder of mean grain size 44 μm, a disc shaped body of a diameter of 25 mm composed of a 60Ta—Cu material was obtained in the same manner as in Example 1. Similarly, a ring shaped body of an inside diameter of 25 mm and an outside diameter of 45 mm composed of a 72.5Ta—Cu material was obtained in the same manner as in Example 1. A contact electrode material was then obtained by combining these two bodies, in which a mean gradient A/X Of Ta component between any point X1 and a point X2 5 mm distant from it across the boundary of these two bodies on any radial line R1 became A/X=2.5 (volume %/mm).

In Example 14, by using powder consisting of a mixture of Mo powder of mean grain size 5 μm and Cu powder of mean grain size 44 μm, a disc shaped body of a diameter of 25 mm composed of a 45Mo—Cu material was obtained in the same manner as in Example 1. Similarly, a ring shaped body of an inside diameter of 25 mm and an outside diameter of 45 mm composed of a 57.5Mo—Cu material was obtained in the same manner as in Example 1. A contact electrode material was then obtained by combining these two bodies, in which a mean gradient A/X of Mo component between any point X1 and a point X2 5 mm distant from it across the boundary of these two bodies on any radial line R1 became A/X=2.5 (volume %/mm).

In Example 15, by using powder consisting of a mixture of W powder of mean grain size 5 μm and Cu powder of mean grain size 44 μm, a disc shaped body of a diameter of 25 mm composed of a 75W—Cu material was obtained in the same manner as in Example 1. Similarly, a ring shaped body of an inside diameter of 25 mm and an outside diameter of 45 mm composed of a 87.5W—Cu material was obtained in the same manner as in Example 1. A contact electrode material was then obtained by combining these two bodies, in which a mean gradient A/X Of W component between any point X1 and a point X2 5 mm distant from it across the boundary of these two bodies on any radial line R1 became A/X=2.5 (volume %/mm).

As is clear from Table 2, the results of evaluation were that both the arc spread properties and the interrupting performances were observed to be improved when compared with Example 1 with gradient value A/X of 0.2. Also, the static withstanding voltage values were judged as in the desirable range because there were no significant differences.

EXAMPLES 16–18

In the above Examples 1–15 and Comparative Examples 1–3, examples were given, in each of which one type of component existed as the arc-proof component in the contact electrode material. However, this invention is not limited to these. A plurality kinds of arc-proof components in the contact electrode material may be selected.

In Example 16, powder consisting of a mixture of Cr powder, Nb powder and Cu powder of above-described mean grain sizes mixed at a ratio so as to form 10 volume % Cr—10 volume % Nb—Cu was molded, sintered and mechanically processed in the same manner as in Example 1 to obtain a disc shaped body of a diameter of 25 mm composed of a 10Cr—10Nb—Cu material. Similarly, a ring shaped body of an inside diameter of 25 mm and an outside diameter of 45 mm composed of a 22.5Cr—10Nb—Cu material was obtained in the same manner as in Example 1. A contact electrode material was then obtained by combining these two bodies in which an inner portion is composed of the 10Cr—10Nb—Cu material and an outer portion is composed of the 22.5Cr—10Nb—Cu material. In this contact electrode material, a mean gradient A/X of Cr component between any point X1 and a point X2 5 mm distant from it across the boundary of these two bodies on any radial line R1 became A/X=2.5 (volume %/mm).

In Example 18, a disc shaped body of a diameter of 15 mm composed of a 0Cr—5Nb—Cu material was obtained in the same manner as in Example 1. Similarly, a first ring shaped body of an inside diameter of 15 mm and an outside diameter of 35 mm composed of a 12.5Cr—5Nb—Cu material and a second ring shaped body of an inside diameter of 35 mm and an outside diameter of 45 mm composed of a 82.5Cr—5Nb—Cu material were obtained in the same manner as in Example 1. A contact electrode material was then obtained by combining these three bodies in which an inner portion is composed of the 0Cr—5Nb—Cu material, an intermediate portion is composed of the 12.5Cr—5Nb—Cu material, and an outer portion is composed of the 82.5Cr—5Nb—Cu material. In this contact electrode material, a mean gradient A/X of Cr component between any point X1 and a point X2 5 mm distant from it across the boundary of the disc shaped body and the first ring shaped body on any radial line R1 became A/X=2.5 (volume %/mm), and a mean gradient A/X of Cr component between any point X1 and a point X2 5 mm distant from it across the boundary of the first and second ring shaped bodies on any radial line R1 became A/X=14 (volume %/mm).

As is clear from Table 2, as a result of these evaluations it was observed that both the arc spread properties and the interrupting performances were improved when compared with Example 1 with gradient value A/X of 0.2. Also, the static withstanding voltage values were judged as in the desirable range because there were no significant differences. Here, Example 17 was deleted.

EXAMPLES 19–22

In the above Embodiments 1–18 and Comparative Examples 1–3, examples are given, in each of which in the contact electrode material an auxiliary component was not added, though a trace of sintering assistant was added in some cases. However, this invention is not limited to these examples. An auxiliary component in the contact electrode material can be selected.

In Example 19, in addition to Cr powder and Cu powder used in Example 1, Bi powder was added as an auxiliary component. Powder consisting of a mixture of Cr powder and Cu powder of above-described mean grain sizes and Bi powder of mean grain size 40 μm mixed at a ratio so as to form 30 volume % Cr-0.1 volume % Bi—Cu was molded, sintered and mechanically processed in the same manner as in Example 1 to obtain a disc shaped body of a diameter of 25 mm composed of a 30Cr-0.1Bi—Cu material. Similarly, a ring shaped body of an inside diameter of 25 mm and an outside diameter of 45 mm composed of a 42.5Cr-0.1Bi—Cu material was obtained in the same manner as in Example 1. A contact electrode material was then obtained by combining these two bodies in which an inner portion is composed of the 30Cr-0.1Bi—Cu material and an outer portion is composed of the 42.5Cr-0.1Bi—Cu material. In this contact electrode material, a mean gradient A/X of Cr component between any point X1 and a point X2 5 mm distant from it across the boundary of these two bodies on any radial line R1 became A/X=2.5 (volume In Example 20, in addition to Cr powder and Cu powder used in Example 1, Pb powder was added as an auxiliary component. By using powder consisting of a mixture of Cr powder and Cu powder of above-described mean grain sizes and Pb powder of mean grain size 40 μm, a disc shaped body of a diameter of 25 mm composed of a 30Cr-0.05Pb—Cu material was obtained in the same manner as in Example 1. Similarly, a ring shaped body of an inside diameter of 25 mm and an outside diameter of 45 mm composed of a 42.5Cr-0.05Pb—Cu material was obtained in the same manner as in Example 1. A contact electrode material was then obtained by combining these two bodies, in which a mean gradient A/X of Cr component between any point X1 and a point X2 5 mm distant from it across the boundary of these two bodies on any radial line R1 became A/X=2.5 (volume %/mm).

In Example 21, in addition to Cr powder and Cu powder used in Example 1, Te powder was added as an auxiliary component. By using powder consisting of a mixture of Cr powder and Cu powder of above-described mean grain sizes and Te powder of mean grain size 40 μm, a disc shaped body of a diameter of 25 mm composed of a 30Cr-4.5Te—Cu material was obtained in the same manner as in Example 1. Similarly, a ring shaped body of an inside diameter of 25 mm and an outside diameter of 45 mm composed of a 42.5Cr-4.5Te—Cu material was obtained in the same manner as in Example 1. A contact electrode material was then obtained by combining these two bodies, in which a mean gradient A/X of Cr component between any point X1 and a point X2 5 mm distant from it across the boundary of these two bodies on any radial line R1 became A/X=2.5 (volume %/mm).

In Example 22, in addition to Cr powder and Cu powder used in Example 1, Sb powder was added as an auxiliary component. By using powder consisting of a mixture of Cr powder and Cu powder of above-described mean grain sizes and Sb powder of mean grain size 40 μm, a disc shaped body of a diameter of 25 mm composed of a 30Cr-0.5Sb—Cu material was obtained in the same manner as in Example 1. Similarly, a ring shaped body of an inside diameter of 25 mm and an outside diameter of 45 mm composed of a 42.5Cr-0.5Sb—Cu material was obtained in the same manner as in Example 1. A contact electrode material was then obtained by combining these two bodies, in which a mean gradient A/X of Cr component between any point X1 and a point X2 5 mm distant from it across the boundary of these two bodies on any radial line R1 became A/X=2.5 (volume %/mm).

As is clear from Table 2, as a result of evaluating these, it was observed that both the arc spread properties and the interrupting performances were improved when compared with Example 1 with gradient value A/X of 0.2. Also, the static withstanding voltage values were judged as in the desirable range because there were no significant differences.

EXAMPLES 23–35

In the above Examples 1–22 and Comparative Examples 1–3, examples were given in each of which Cu was given as the conductive component in the contact electrode material. However, this invention is not limited to these Examples. Another conductive component can be selected in the contact electrode material.

Furthermore, in the above Examples 1–22 and Comparative Examples 1–3, Examples were given in which metal components such as Cr and Ti and so on were given as the arc-proof component in the contact electrode material. However, this invention is not limited to these Examples. Other arc-proof components in the contact electrode material can be selected.

In Example 23, powder consisting of a mixture of WC powder of mean grain size 3 μm, Co powder of mean grain size 10 μm and Ag powder of mean grain size 40 μm mixed at a ratio so as to form 30 volume % WC-1 volume % Co—Ag was molded, sintered and mechanically processed in the same manner as in Example 1 to obtain a disc shaped body of a diameter of 25 mm composed of a 30WC-1Co—Ag material. Similarly, a ring shaped body of an inside diameter of 25 mm and an outside diameter of 45 mm composed of a 42.5WC-1Co—Ag material was obtained in the same manner as in Example 1. A contact electrode material was then obtained by combining these two bodies in which an inner portion is composed of the 30WC-1Co—Ag material and an outer portion is composed of the 42.5WC-1Co—Ag material. In this contact electrode material, a mean gradient A/X of WC component between any point X1 and a point X2 5 mm distant from it across the boundary of these two bodies on any radial line R1 became A/X=2.5 (volume %/mm).

In Example 24, in addition to the powders used in Example 23, Cu powder of above-described mean grain size was added. By using powder consisting of a mixture of WC, Co, Ag and Cu powders of above-described mean grain sizes, a disc shaped body of a diameter of 25 mm composed of a 30WC-1Co-14Cu—Ag material was obtained in the same manner as in Example 1. Similarly, a ring shaped body of an inside diameter of 25 mm and an outside diameter of 45 mm composed of a 42.5WC-1Co-11Cu—Ag material was obtained in the same manner as in Example 1. A contact electrode material was then obtained by combining these two bodies, in which a mean gradient A/X of WC component between any point X1 and a point X2 5 mm distant from it across the boundary of these two bodies on any radial line R1 became A/X=2.5 (volume %/mm).

In Example 25, in addition to WC and Ag powders used in Example 23, Ni powder of mean grain size 10 μm was added. By using powder consisting of a mixture of WC, Ag and Ni powders of above-described mean grain sizes, a disc shaped body of a diameter of 25 mm composed of a 30WC-3Ni—Ag material was obtained in the same manner as in Example 1. Similarly, a ring shaped body of an inside diameter of 25 mm and an outside diameter of 45 mm composed of a 42.5WC-3Ni—Ag material was obtained in the same manner as in Example 1. A contact electrode material was then obtained by combining these two bodies, in which a mean gradient A/X of WC component between any point X1 and a point X2 5 mm distant from it across the boundary of these two bodies on any radial line R1 became A/X=2.5 (volume %/mm).

In Example 26, in addition to WC and Ag powders used in Example 23, Fe powder of mean grain size 10 μm was added. By using powder consisting of a mixture of WC, Ag and Fe powders of above-described mean grain sizes, a disc shaped body of a diameter of 25 mm composed of a 30WC-10Fe—Ag material was obtained in the same manner as in Example 1. Similarly, a ring shaped body of an inside diameter of 25 mm and an outside diameter of 45 mm composed of a 42.5WC-10Fe—Ag material was obtained in the same manner as in Example 1. A contact electrode material was then obtained by combining these two bodies, in which a mean gradient A/X of WC component between any point X1 and a point X2 5 mm distant from it across the boundary of these two bodies on any radial line R1 became A/X=2.5 (volume %/mm).

In Example 27, in addition to Co and Ag powders used in Example 23, TiC powder of mean grain size 5 μm was added. By using powder consisting of a mixture of Co, Ag and TiC powders of above-described mean grain sizes, a disc shaped body of a diameter of 25 mm composed of a 30TiC-1Co—Ag material was obtained in the same manner as in Example 1. Similarly, a ring shaped body of an inside diameter of 25 mm and an outside diameter of 45 mm composed of a 42.5TiC-1Co—Ag material was obtained in the same manner as in Example 1. A contact electrode material was then obtained by combining these two bodies, in which a mean gradient A/X of TiC component between any point X1 and a point X2 5 mm distant from it across the boundary of these two bodies on any radial line R1 became A/X=2.5 (volume %/mm).

In Example 28, in addition to Co and Ag powders used in Example 23, ZrC powder of mean grain size 5 μm was added. By using powder consisting of a mixture of Co, Ag and ZrC powders of above-described mean grain sizes, a disc shaped body of a diameter of 25 mm composed of a 30ZrC-1Co—Ag material was obtained in the same manner as in Example 1. Similarly, a ring shaped body of an inside diameter of 25 mm and an outside diameter of 45 mm composed of a 42.5ZrC-1Co—Ag material was obtained in the same manner as in Example 1. A contact electrode material was then obtained by combining these two bodies, in which a mean gradient A/X of ZrC component between any point X1 and a point X2 5 mm distant from it across the boundary of these two bodies on any radial line R1 became A/X=2.5 (volume %/mm).

In Example 29, in addition to Co and Ag powders used in Example 23, VC powder of mean grain size 5 μm was added. By using powder consisting of a mixture of Co, Ag and VC powders of above-described mean grain sizes, a disc shaped body of a diameter of 25 mm composed of a 30VC-1Co—Ag material was obtained in the same manner as in Example 1. Similarly, a ring shaped body of an inside diameter of 25 mm and an outside diameter of 45 mm composed of a 42.5VC-1Co—Ag material was obtained in the same manner as in Example 1. A contact electrode material was then obtained by combining these two bodies, in which a mean gradient A/X of VC component between any point X1 and a point X2 5 mm distant from it across the boundary of these two bodies on any radial line R1 became A/X=2.5 (volume %/mm).

In Example 30, in addition to Co and Ag powders used in Example 23, NbC powder of mean grain size 10 μm was added. By using powder consisting of a mixture of Co, Ag and NbC powders of above-described mean grain sizes, a disc shaped body of a diameter of 25 mm composed of a 30NbC-1Co—Ag material was obtained in the same manner as in Example 1. Similarly, a ring shaped body of an inside diameter of 25 mm and an outside diameter of 45 mm composed of a 42.5NbC-1Co—Ag material was obtained in the same manner as in Example 1. A contact electrode material was then obtained by combining these two bodies, in which a mean gradient A/X of NbC component between any point X1 and a point X2 5 mm distant from it across the boundary of these two bodies on any radial line R1 became A/X=2.5 (volume %/mm).

In Example 31, in addition to Co and Ag powders used in Example 23, TaC powder of mean grain size 10 μm was added. By using powder consisting of a mixture of Co, Ag and TaC powders of above-described mean grain sizes, a disc shaped body of a diameter of 25 mm composed of a 30TaC-1Co—Ag material was obtained in the same manner as in Example 1. Similarly, a ring shaped body of an inside diameter of 25 mm and an outside diameter of 45 mm composed of a 42.5TaC-1Co—Ag material was obtained in the same manner as in Example 1. A contact electrode material was then obtained by combining these two bodies, in which a mean gradient A/X of TaC component between any point X1 and a point X2 5 mm distant from it across the boundary of these two bodies on any radial line R1 became A/X=2.5 (volume %/mm).

In Example 32, in addition to Co and Ag powders used in Example 23, $Cr_3C_2$ powder of mean grain size 10 μm was added. By using powder consisting of a mixture of Co, Ag and $Cr_3C_2$powders of above-described mean grain sizes, a disc shaped body of a diameter of 25 mm composed of a 30$Cr_3C_2$-1Co—Ag material was obtained in the same manner as in Example 1. Similarly, a ring shaped body of an inside diameter of 25 mm and an outside diameter of 45 mm composed of a 42.5$Cr_3C_2$-1Co—Ag material was obtained in the same manner as in Example 1. A contact electrode material was then obtained by combining these two bodies, in which a mean gradient A/X of $Cr_3C_2$component between any point X1 and a point X2 5 mm distant from it across the boundary of these two bodies on any radial line R1 became A/X=2.5 (volume %/mm).

In Example 33, in addition to Co and Ag powders used in Example 23, $Mo_2C$ powder of mean grain size 10 μm was added. By using powder consisting of a mixture of Co, Ag and $Mo_2C$ powders of above-described mean grain sizes, a disc shaped body of a diameter of 25 mm composed of a 30$Mo_2C$-1Co—Ag material was obtained in the same manner as in Example 1. Similarly, a ring shaped body of an inside diameter of 25 mm and an outside diameter of 45 mm composed of a 42.5$Mo_2C$-1Co—Ag material was obtained in the same manner as in Example 1. A contact electrode material was then obtained by combining these two bodies, in which a mean gradient A/X of $Mo_2C$ component between any point X1 and a point X2 5 mm distant from it across the boundary of these two bodies on any radial line R1 became A/X=2.5 (volume %/mm).

In Example 34, in addition to Co and Ag powders used in Example 23, TiB powder of mean grain size 5 μm was added. By using powder consisting of a mixture of Co, Ag and Tib powders of above-described mean grain sizes, a disc shaped body of a diameter of 25 mm composed of a 30TiB-1Co—Ag material was obtained in the same manner as in Example 1. Similarly, a ring shaped body of an inside diameter of 25 mm and an outside diameter of 45 mm composed of a 42.5TiB-1Co—Ag material was obtained in the same manner as in Example 1. A contact electrode material was then obtained by combining these two bodies, in which a mean gradient A/X of TiB component between any point X1 and a point X2 5 mm distant from it across the boundary of these two bodies on any radial line R1 became A/X=2.5 (volume %/mm).

In Example 35, in addition to Co and Ag powders used in Example 23, $Cr_2B$ powder of mean grain size 5 μm was added. By using powder consisting of a mixture of Co, AG and $Cr_2B$ powders of above-described mean grain sizes, a disc shaped body of a diameter of 25 mm composed of a 30$Cr_2B$-1Co—Ag material was obtained in the same manner as in Example 1. Similarly, a ring shaped body of an inside diameter of 25 mm and an outside diameter of 45 mm composed of a 42.5$Cr_2B$-1Co—Ag material was obtained in the same manner as in Example 1. A contact electrode material was then obtained by combining these two bodies, in which a mean gradient A/X of $Cr_2B$ component between any point X1 and a point X2 5 mm distant from it across the boundary of these two bodies on any radial line R1 became A/X=2.5 (volume %/mm).

As is clear from Table 3, as the result of these evaluations, it was observed that both the arc spread properties and the interrupting performances were improved when compared with Example 1 with gradient value A/X of 0.2. Also, the static withstanding voltage values were judged as in the desirable range because there were no significant differences.

In the above-described Examples, as the composition component which gives concentration gradient A/X, an arc-proof component was taken. This invention is, however, not limited to these Examples. It was proved that in other Examples, instead of the arc-proof component, a conductive component can be taken as the composition component which gives concentration gradient A/X of 0.2–12 (volume %/mm) on the contact electrode surface.

From the above, as an effective technique for improvement of the interrupting performance of contact electrode, it is proved that it is important to make the value of the concentration gradient A/X of the composition component which is one of conductive component and arc-proof component on the contact electrode surface to be 0.2–12 (volume %/mm). Moreover, it is proved that it is not necessary to give the entire contact electrode surface with this gradient value, but that it is effective if a domain with this gradient value is present in part of the contact electrode surface. Also, Examples were mainly shown which the contact electrode was produced by the CuCr contact electrode material. However, it was also proved that this invention is effective in the contact electrode produced by other material systems as described in Examples. Contact electrode of this invention which is based on this information is very advantageous for the improvement of the interrupting performance of the vacuum circuit breaker while maintaining the withstanding voltage property.

TABLE 1

| | Composition Component | | |
|---|---|---|---|
| | Conductive Component | Arc-proof Component | Auxiliary Component |
| Comparative Example-1 | Cu | Cr | None |
| Comparative Example-2 | Cu | Cr | None |
| Example-1 | Cu | Cr | None |
| Example-2 | Cu | Cr | None |
| Example-3 | Cu | Cr | None |
| Comparative Example-3 | Cu | Cr | None |
| Example-4 | — | — | — |
| Example-5 | Cu | Cr | None |
| Example-6 | Cu | Cr | None |
| Example-7 | Cu | Cr | None |
| Example-8 | Cu | Cr | None |

| | State of Contact Electrode Surface | | | |
|---|---|---|---|---|
| | Type of Composition Component giving | Gradient A/X (volume %/mm) across the N-th boundary N: counted from the center of the contact electrode | | |
| | Gradient | N = 1 | N = 2 | N = 3 |
| Comparative Example-1 | Cr | — | — | — |
| Comparative Example-2 | Cr | 0.16 | — | — |
| Example-1 | Cr | 0.2 | — | — |
| Example-2 | Cr | 2.5 | — | — |
| Example-3 | Cr | 12 | — | — |
| Comparative Example-3 | Cr | 20 | — | — |
| Example-4 | — | — | — | — |
| Example-5 | Cr | 0.16 | 2.5 | — |
| Example-6 | Cr | 2.5 | 4.5 | — |
| Example-7 | Cr | 2.5 | 14 | — |
| Example-8 | Cr | 0.16 | 2.5 | 14 |

TABLE 1-continued

| | Amount of Arc Spread Relative values, taking the spread area of Example-1 as 100 | Interrupting Performance (Interrupting Multiplying Factor) Relative values, taking interrupting current value of Example-1 as 1.00 | Withstanding Voltage Performance (Static withstand Voltage value) Relative values, taking the withstanding voltage value of Example-1 as 1.00 |
|---|---|---|---|
| Comparative Example-1 | 30–55 | 0.65 | 1.0–1.1 |
| Comparative Example-2 | 40–60 | 0.75 | 1.0–1.1 |
| Example-1 | 100 | 1.00 | 1.00 |
| Example-2 | 130–160 | 1.5 | 1.0–1.1 |
| Example-3 | 120–135 | 1.3 | 1.0–1.1 |
| Comparative Example-3 | 65–90 | 0.7 | 0.8–1.05 |
| Example-4 | — | — | — |
| Example-5 | 115–130 | 1.4 | 1.0–1.1 |
| Example-6 | 110–125 | 1.3 | 1.0–1.1 |
| Example-7 | 110–120 | 1.25 | 1.0–1.1 |
| Example-8 | 110–125 | 1.2 | 1.0–1.1 |

TABLE 2

| | Composition Component | | |
|---|---|---|---|
| | Conductive Component | Arc-proof Component | Auxiliary Component |
| Example-9 | Cu | Ti | None |
| Example-10 | Cu | Zr | None |
| Example-11 | Cu | V | None |
| Example-12 | Cu | Nb | None |
| Example-13 | Cu | Ta | None |
| Example-14 | Cu | Mo | None |
| Example-15 | Cu | W | None |
| Example-16 | Cu | CrNb | None |
| Example-17 | — | — | — |
| Example-18 | Cu | CrNb | None |
| Example-19 | Cu | Cr | Bi |
| Example-20 | Cu | Cr | Pb |
| Example-21 | Cu | Cr | Te |
| Example-22 | Cu | Cr | Sb |

| | State of Contact Electrode Surface | | | |
|---|---|---|---|---|
| | Type of Composition Component giving | Gradient A/X (volume %/mm) across the N-th boundary N: counted from the center of the contact electrode | | |
| | Gradient | N = 1 | N = 2 | N = 3 |
| Example-9 | Ti | 2.5 | — | — |
| Example-10 | Zr | 2.5 | — | — |
| Example-11 | V | 2.5 | — | — |
| Example-12 | Nb | 2.5 | — | — |
| Example-13 | Ta | 2.5 | — | — |
| Example-14 | Mo | 2.5 | — | — |
| Example-15 | W | 2.5 | — | — |
| Example-16 | Cr | 2.5 | — | — |
| Example-17 | — | — | — | — |
| Example-18 | Cr | 2.5 | 14 | — |
| Example-19 | Cr | 2.5 | — | — |
| Example-20 | Cr | 2.5 | — | — |
| Example-21 | Cr | 2.5 | — | — |
| Example-22 | Cr | 2.5 | — | — |

TABLE 2-continued

| | Amount of Arc Spread Relative values, taking the spread area of Example-1 as 100 | Interrupting Performance (Interrupting Multiplying Factor) Relative values, taking interrupting current value of Example-1 as 1.00 | Withstanding Voltage Performance (Static withstand Voltage value) Relative values, taking the withstanding voltage value of Example-1 as 1.00 |
|---|---|---|---|
| Example-9 | 130–145 | 1.4 | 1.0–1.1 |
| Example-10 | 125–135 | 1.25 | 1.0–1.1 |
| Example-11 | 120–130 | 1.25 | 1.0–1.1 |
| Example-12 | 120–130 | 1.2 | 1.0–1.1 |
| Example-13 | 110–125 | 1.2 | 1.0–1.1 |
| Example-14 | 110–125 | 1.2 | 1.0–1.1 |
| Example-15 | 110–125 | 1.2 | 1.0–1.1 |
| Example-16 | 125–135 | 1.5 | 1.0–1.1 |
| Example-17 | — | — | — |
| Example-18 | 115–135 | 1.4 | 1.0–1.1 |
| Example-19 | 115–125 | 1.35 | 0.95–1.1 |
| Example-20 | 115–125 | 1.3 | 0.95–1.0 |
| Example-21 | 110–125 | 1.3 | 0.95–1.0 |
| Example-22 | 110–120 | 1.2 | 0.95–1.0 |

TABLE 3

| | Composition Component | | |
|---|---|---|---|
| | Conductive Component | Arc-proof Component | Auxiliary Component |
| Example-23 | Ag | WC | Co |
| Example-24 | 8Ag:2Cu | WC | Co |
| Example-25 | Ag | WC | Ni |
| Example-26 | Ag | WC | Fe |
| Example-27 | Ag | TiC | Co |
| Example-28 | Ag | ZrC | Co |
| Example-29 | Ag | VC | Co |
| Example-30 | Ag | NbC | Co |
| Example-31 | Ag | TaC | Co |
| Example-32 | Ag | $Cr_3C_2$ | Co |
| Example-33 | Ag | $Mo_2C$ | Co |
| Example-34 | Ag | TiB | Co |
| Example-35 | Ag | $Cr_2B$ | Co |

| | State of Contact Electrode Surface | | | |
|---|---|---|---|---|
| | Type of Composition Component giving | Gradient A/X (volume %/mm) across the N-th boundary N: counted from the center of the contact electrode | | |
| | Gradient | N = 1 | N = 2 | N = 3 |
| Example-23 | WC | 2.5 | — | — |
| Example-24 | WC | 2.5 | — | — |
| Example-25 | WC | 2.5 | — | — |
| Example-26 | WC | 2.5 | — | — |
| Example-27 | TiC | 2.5 | — | — |
| Example-28 | ZrC | 2.5 | — | — |
| Example-29 | VC | 2.5 | — | — |
| Example-30 | NbC | 2.5 | — | — |
| Example-31 | TaC | 2.5 | — | — |
| Example-32 | $Cr_3C_2$ | 2.5 | — | — |
| Example-33 | $Mo_2C$ | 2.5 | — | — |
| Example-34 | TiB | 2.5 | — | — |
| Example-35 | $Cr_2B$ | 2.5 | — | — |

TABLE 3-continued

| | Amount of Arc Spread Relative values, taking the spread area of Example-1 as 100 | Interrupting Performance (Interrupting Multiplying Factor) Relative values, taking interrupting current value of Example-1 as 1.00 | Withstanding Voltage Performance (Static withstand Voltage value) Relative values, taking the withstanding voltage value of Example-1 as 1.00 |
|---|---|---|---|
| Example-23 | 110–130 | 1.25 | 0.95–1.0 |
| Example-24 | 125–140 | 1.35 | 0.95–1.0 |
| Example-25 | 115–130 | 1.25 | 0.95–1.0 |
| Example-26 | 110–130 | 1.25 | 0.95–1.0 |
| Example-27 | 125–130 | 1.3 | 0.95–1.0 |
| Example-28 | 115–125 | 1.25 | 0.95–1.0 |
| Example-29 | 110–125 | 1.2 | 0.95–1.0 |
| Example-30 | 115–125 | 1.2 | 0.95–1.0 |
| Example-31 | 110–120 | 1.2 | 0.95–1.0 |
| Example-32 | 110–120 | 1.2 | 0.95–1.0 |
| Example-33 | 110–120 | 1.3 | 0.95–1.0 |
| Example-34 | 115–120 | 1.25 | 0.95–1.0 |
| Example-35 | 110–120 | 1.25 | 0.95–1.0 |

The arc-proof components used in the above-described Examples, have melting points of more than 1500° C., respectively.

Moreover, as for the quantity of arc-proof component of the contact electrode, this invention can be applied to the contact electrode including arc-proof component of 5–75 volume %.

When using this invention, a contact electrode for a vacuum interrupter can be provided which can improve large current interrupting characteristics by optimising the composition component quantity gradient of the contact electrode surface, while maintaining the excellent withstanding voltage property.

Obviously, numerous modifications and variations of the present invention are possible in light of the above teachings. It is therefore to be understood that within the scope of the appended claims, the invention may be practiced otherwise than as specifically described herein.

What is claimed is:

1. A contact electrode for a vacuum interrupter, comprising:

a conductive component comprising at least one selected from the group consisting of copper and silver; and an arc-proof component with a melting temperature of more than 1500° C.;

a gradient A/X of a quantity of a composition component of said contact electrode on a surface of said contact electrode being 0.2–12 volume %/mm;

wherein,

X1 is one point on the line of any radius R1 on said surface of said contact electrode;

X2 is another point on the line of said radius R1 on said surface of said contact electrode;

X is a gap between said one point X1 and said another point X2 measured by mm, where X=X2–X1, and X2>X1≧0;

A1 is a quantity of said composition component measured by volume % in said contact electrode at said one point X1:

A2 is a quantity of said composition component measured by volume % in said contact electrode at said another point X2; and A is a difference between said quantities A1 and A2 of said composition component measured by volume %, where A=A2–A1.

2. The contact electrode for a vacuum interrupter according to claim 1, wherein:

said composition component includes said conductive component.

3. The contact electrode for a vacuum interrupter according to claim 1, wherein:

said composition component includes said arc-proof component.

4. The contact electrode for a vacuum interrupter according to claim 1, wherein:

an amount of said arc-proof component is from 5% to 75% by volume % in said contact electrode.

5. The contact electrode for a vacuum interrupter according to claim 1, wherein:

said arc-proof component is at least one selected from the group consisting of titanium, zirconium, vanadium, niobium, tantalum, chromium, molybdenum and tungsten.

6. The contact electrode for a vacuum interrupter according to claim 1, wherein:

said arc-proof component is at least one selected from the group consisting of carbides and borides of titanium, zirconium, vanadium, niobium, tantalum, chromium, molybdenum and tungsten.

7. The contact electrode for a vacuum interrupter according to claim 1, further comprising:

an auxiliary component comprising at least one selected from the group consisting of cobalt, nickel and iron.

8. The contact electrode for a vacuum interrupter according to claim 1, further comprising:

an auxiliary component comprising at least one selected from the group consisting of bismuth, tellurium, lead and antimony.

9. The contact electrode for a vacuum interrupter according to claim 1, wherein:

a first domain having said gradient A/X of less than 0.2 volume %/mm, and a second domain having said gradient A/X of 0.2–12 volume %/mm coexist along said line of said radius R1 on said surface of said contact electrode.

10. The contact electrode for a vacuum interrupter according to claim 1, wherein:

a first domain having said gradient A/X of less than 0.2 volume %/mm, a second domain having said gradient A/X of 0.2–12 volume %/mm and a third domain having said gradient A/X of more than 12 volume %/mm exist in this order in the direction from the center to the peripheral of said contact electrode.

11. The contact electrode for a vacuum interrupter according to claim 1, wherein:

a first domain having said gradient A/X of less than 0.2 volume %/mm exist between the center of the diameter of said contact electrode and said one point X1 along said line of said radius R1 on said surface of said contact electrode; and said first domain and a second domain having said gradient A/X of 0.2–12 volume %/mm coexist between said one point X1 and the peripheral of said contact electrode along said line of said radius R1 on said surface of said contact electrode.

12. A contact electrode for a vacuum interrupter, comprising:

a substrate composed of a first conductive component comprising at least one selected from the group consisting of copper and silver; and a thin contact electrode mounted on said substrate;

said thin contact electrode including;

a second conductive component comprising at least one selected from the group consisting of copper and silver, and an arc-proof component with a melting temperature of more than 1500° C., and a gradient A/X of a quantity of a composition component of said thin contact electrode composed of one of said second conductive component and said arc-proof component on a surface of said thin contact electrode being 0.2–12 volume %/mm;

wherein,

X1 is one point on the line of any radius R1 on said surface of said thin contact electrode, X2 is another point on the line of said radius R1 on said surface of said thin contact electrode, X is a gap between said one point X1 and said another point X2 measured by mm, where $X=X2-X1$, and $X2>X1\geqq 0$, A1 is a quantity of said composition component measured by volume % in said thin contact electrode at said one point X1, A2 is a quantity of said composition component measured by volume % in said thin contact electrode at said another point X2, and A is s difference between said quantities A1 and A2 of said composition component measured by volume %, where $A=A2-A1$.

* * * * *